US011156135B2

(12) United States Patent
Baltrucki et al.

(10) Patent No.: US 11,156,135 B2
(45) Date of Patent: Oct. 26, 2021

(54) SYSTEMS AND METHODS FOR COMBINED ENGINE BRAKING AND LOST MOTION EXHAUST VALVE OPENING

(71) Applicant: Jacobs Vehicle Systems, Inc., Bloomfield, CT (US)

(72) Inventors: Justin D. Baltrucki, Canton, CT (US); David M. Ferreira, Glastonbury, CT (US)

(73) Assignee: JACOBS VEHICLE SYSTEMS, INC., Bloomfield, CT (US)

( * ) Notice: Subject to any disclaimer, the term of this patent is extended or adjusted under 35 U.S.C. 154(b) by 56 days.

(21) Appl. No.: 16/513,608

(22) Filed: Jul. 16, 2019

(65) Prior Publication Data

US 2020/0018243 A1 Jan. 16, 2020

Related U.S. Application Data

(60) Provisional application No. 62/698,727, filed on Jul. 16, 2018.

(51) Int. Cl.

| | |
|---|---|
| ***F01L 13/06*** | (2006.01) |
| ***F02D 13/02*** | (2006.01) |
| ***F02D 13/04*** | (2006.01) |
| ***F01L 1/18*** | (2006.01) |
| ***F01L 1/46*** | (2006.01) |
| ***F01L 1/26*** | (2006.01) |

(52) U.S. Cl.

CPC ..... *F01L 13/06* (2013.01); *F01L 1/181* (2013.01); *F01L 1/267* (2013.01); *F01L 1/46* (2013.01); *F01L 13/065* (2013.01); *F02D 13/0242* (2013.01); *F02D 13/04* (2013.01); *F01L 2001/467* (2013.01); *F02D 2200/023* (2013.01); *F02D 2200/0802* (2013.01); *F02D 2200/101* (2013.01); *F02D 2200/1002* (2013.01)

(58) Field of Classification Search

CPC ..... F01L 13/06; F01L 1/181; F01L 13/065; F01L 2305/00; F01L 1/18; F01L 1/26; F01L 1/267; F01L 2001/186; F01L 1/46; F01L 2001/467; F02D 13/04; F02D 13/0242; F02D 2200/0802; F02D 2200/1002; F02D 2200/023; F02D 2200/101; F02D 13/0246

USPC ..... 123/90.16, 90.15

See application file for complete search history.

(56) References Cited

U.S. PATENT DOCUMENTS 5,255,650 A * 10/1993 Faletti ..... F02D 13/04 123/322

6,354,254 B1 * 3/2002 Usko ..... F01L 13/06 123/90.16

(Continued)

OTHER PUBLICATIONS

International Search Report and Written Opinion for International Application No. PCT/US2019/042090 dated Oct. 21, 2019, 8 pages.

*Primary Examiner* — Patrick Hamo
*Assistant Examiner* — Wesley G Harris
(74) *Attorney, Agent, or Firm* — Moreno IP Law LLC

(57) ABSTRACT

A combined dedicated braking and EEVO lost motion valve actuation systems for internal combustion engines provide subsystems for braking events and EEVO events on one or more cylinders. Various control strategies may utilize braking and EEVO capabilities to module one or more engine parameters, including aftertreatment temperature and engine load.

16 Claims, 13 Drawing Sheets

(56) References Cited

U.S. PATENT DOCUMENTS

| | | | | |
|---|---|---|---|---|
| 7,712,449 | B1 * | 5/2010 | Schwoerer | F01L 13/065 123/321 |
| 7,905,208 | B2 * | 3/2011 | Ruggiero | F02D 13/04 123/90.22 |
| 9,845,713 | B2 | 12/2017 | Ernest et al. | |
| 2006/0081213 | A1 | 4/2006 | Yang et al. | |
| 2012/0048232 | A1 | 3/2012 | Meistrick | |
| 2014/0251266 | A1 * | 9/2014 | Emmons | F01L 13/065 123/321 |

* cited by examiner

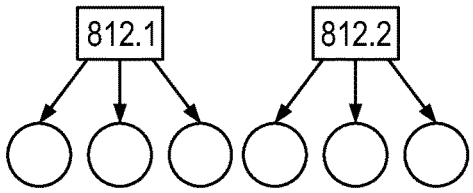
FIG. 10.1
| HEAT LEVEL | SOLENOID | CYL1 | CYL2 | CYL3 | CYL4 | CYL5 | CYL6 |
|---|---|---|---|---|---|---|---|
| 1 | 1 | X | X | X | 0 | 0 | 0 |
| 2 | 1 and 2 | X | X | X | X | X | X |
FIG. 10.2
| HEAT LEVEL | SOLENOID | CYL1 | CYL2 | CYL3 | CYL4 | CYL5 | CYL6 |
|---|---|---|---|---|---|---|---|
| 1 | 1 | X | X | X | 0 | 0 | 0 |
| 2 | 2 | 0 | 0 | 0 | X | X | X |
| 3 | 1 and 2 | X | X | X | X | X | X |
FIG. 10.3
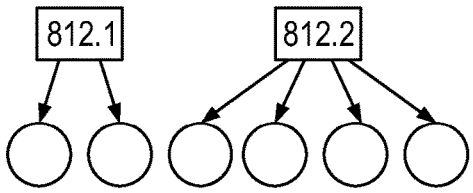
FIG. 11.1

| HEAT LEVEL | SOLENOID | CYL1 | CYL2 | CYL3 | CYL4 | CYL5 | CYL6 |
|---|---|---|---|---|---|---|---|
| 1 | 1 | X | X | 0 | 0 | 0 | 0 |
| 2 | 2 | 0 | 0 | X | X | X | X |
| 3 | 1 and 2 | X | X | X | X | X | X |
FIG. 11.2
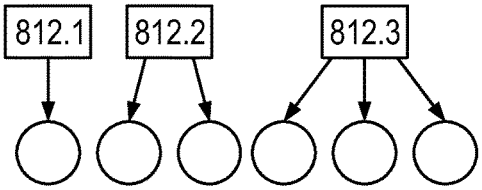
FIG. 12.1
| HEAT LEVEL | SOLENOID | CYL1 | CYL2 | CYL3 | CYL4 | CYL5 | CYL6 |
|---|---|---|---|---|---|---|---|
| 1 | 1 | X | 0 | 0 | 0 | 0 | 0 |
| 2 | 2 | 0 | X | X | 0 | 0 | 0 |
| 3 | 1 and 2 | X | X | X | 0 | 0 | 0 |
| 4 | 1+3 | X | 0 | 0 | X | X | X |
| 5 | 2+3 | 0 | X | X | X | X | X |
| 6 | 1+2+3 | X | X | X | X | X | X |
FIG. 12.2
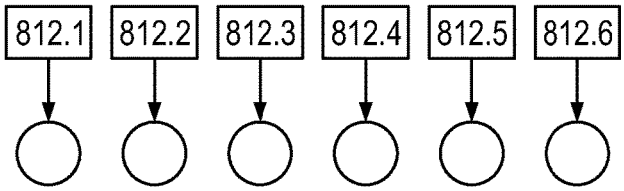
FIG. 13.1

| CYLINDER | EEVO ACTIVE | EEVO ACTIVE | EEVO ACTIVE | EEVO ACTIVE | EEVO ACTIVE | EEVO ACTIVE | EEVO ACTIVE |
|---|---|---|---|---|---|---|---|
| 1 | 0 | X | 0 | X | 0 | X | 0 |
| 2 | X | 0 | X | 0 | X | 0 | X |
| 3 | 0 | X | 0 | X | 0 | X | 0 |
| 4 | X | 0 | X | 0 | X | 0 | X |
| 5 | 0 | X | 0 | X | 0 | X | 0 |
| 6 | X | 0 | X | 0 | X | 0 | X |
| | CYCLE 0 | CYCLE 1 | CYCLE 2 | CYCLE 3 | CYCLE 4 | CYCLE 5 | CYCLE X |

FIG. 13.2

| 25% DUTY CYCLE | | | | | | | |
|---|---|---|---|---|---|---|---|
| CYLINDER | EEVO ACTIVE | EEVO ACTIVE | EEVO ACTIVE | EEVO ACTIVE | EEVO ACTIVE | EEVO ACTIVE | EEVO ACTIVE |
| 1 | 0 | 0 | 0 | X | 0 | 0 | 0 |
| 2 | X | 0 | 0 | 0 | X | 0 | 0 |
| 3 | 0 | X | 0 | 0 | 0 | X | 0 |
| 4 | 0 | 0 | X | 0 | 0 | 0 | X |
| 5 | 0 | 0 | 0 | X | 0 | 0 | 0 |
| 6 | X | 0 | 0 | 0 | X | 0 | 0 |
| | CYCLE 0 | CYCLE 1 | CYCLE 2 | CYCLE 3 | CYCLE 4 | CYCLE 5 | CYCLE X |

FIG. 13.3

SYSTEMS AND METHODS FOR COMBINED ENGINE BRAKING AND LOST MOTION EXHAUST VALVE OPENING

RELATED APPLICATIONS AND PRIORITY CLAIM

The instant application claims priority to U.S. provisional patent application Ser. No. 62/698,727 filed on Jul. 16, 2018 and titled SYSTEMS AND METHODS FOR COMBINED ENGINE BRAKING AND LOST MOTION EXHAUST VALVE OPENING, the subject matter of which is incorporated herein in its entirety.

FIELD

The instant disclosure relates generally to systems and methods for actuating one or more engine valves in an internal combustion engine. In particular, embodiments of the instant disclosure relate to systems and methods for combined engine braking and lost motion exhaust valve opening.

BACKGROUND

Internal combustion engines, such as heavy-duty diesel (HDD) engines, are well known in the art and utilized ubiquitously in many applications and industries, including transportation and trucking. These engines utilize engine valve actuation systems that facilitate a positive power mode of operation in which the engine cylinders generate power from combustion processes. The intake and exhaust valve actuation motions associated with the standard combustion cycle are typically referred to as "main event" motions. In addition to main event motions, known engine valve actuation systems may facilitate auxiliary valve actuation motions or events that allow an internal combustion engine to operate in other modes, or in variations of positive power generation mode (e.g., exhaust gas recirculation (EGR), early exhaust valve opening (EEVO), etc.) or engine braking in which the internal combustion engine is operated in an unfueled state, essentially as an air compressor, to develop retarding power to assist in slowing down the vehicle. Further still, variants in valve actuation motions used to provide engine braking are known (e.g., brake gas recirculation (BGR), bleeder braking, etc.)

Valve actuation systems may include lost motion components to facilitate operation of an internal combustion engine in positive power and engine braking modes. Lost motion components are well-known in the art. These devices typically include elements that may, in a controlled fashion, collapse or alter their length or engage/disengage adjacent components within a valve train to alter valve motion. Lost motion devices may facilitate certain valve actuation motions during the engine cycle that vary from the motion dictated by fixed-profile valve actuation motion sources such as rotating cams. Lost motion devices may cause such motion to be selectively "lost," i.e., not conveyed via the valve train to one or more engine valves in order to achieve events that are in addition to, or variations of, main event valve motion. Known lost motion devices include collapsing or lost motion valve bridges, which may selectively convey valve train motion to two engine valves spanned by the bridge.

Generally, HDD engines may be required to have engine brakes to provide braking action on the engine to assist in slowing the vehicles, for example, during long descents on steep grades. Furthermore, HDD engines may utilize emission controls in order to meet required emission standards. Such emission controls may utilize valve motion controls, including controls that modify main exhaust valve events (i.e., those valve actuation motions applied to exhaust valves to implement positive power generation) to regulate exhaust temperatures for highly efficient operation of catalysts and regeneration of aftertreatment particulate filters. The use of EEVO events for this purpose is well known. Opening an exhaust valve early releases combustion gas into the exhaust system before it has fully expanded in cylinder. The energy in the exhaust system is thereby increased, which increased energy is beneficial in providing the above-noted emissions control.

To effectuate EEVO events, or other potentially beneficial valve events, so-called variable valve actuation (VVA) systems are known in the art. For example, some VVA systems simply advance the otherwise-fixed exhaust camshaft timing of the exhaust to open exhaust valves earlier and increase the exhaust temperatures. However, this approach also modifies the exhaust valve closing timing, which has adverse effects on residual exhaust gasses in the cylinder. Furthermore, such advancement of the camshaft timing necessarily affects all cylinders on the same camshaft, which may not be desirable in all instances.

Additionally, certain engine configurations are not readily adaptable to known VVA timing advancement approaches. For example, single overhead cam (SOHC) engines (or "cam in block" engines), which typically include intake valve and exhaust valve cams on a single camshaft, advance both intake and exhaust valves according to a fixed timing. Applying known VVA approaches to such configurations is not desirable due to potential piston clearance issues on intake valve opening. While some engine configurations exist (e.g., so-called "CAM in CAM" systems) that may theoretically be adapted to permit valve timing advancement to be performed independently, these systems are complex, expensive and have limited angular adjustment. Further still, other known VVA systems may employ hydraulic valvetrain systems and high-speed solenoids that can be used to open an exhaust almost anywhere in an engine cycle. While such systems exhibit great flexibility and could be used to implement EEVO events, once again, they are relatively complex and costly.

While lost motion devices, such as collapsing or locking valve bridges (or other valve train components) operate well for their intended purpose, various improvements thereto, including lost motion and valve train configurations that more readily support engine braking and emission control functions, such as EEVO, required in HDD and other engines, would be a welcome addition in the art. More specifically, improvements providing ease of assembly, lower manufacturing cost and more dependable and durable operation of lost motion valve train components, such as collapsing valve bridges, would contribute to the state of the art. Moreover, engine control strategies that improve control of engine parameters that affect engine braking, emissions and other operating parameters would be a welcome addition to the art. It would therefore be advantageous to provide systems and methods that address the aforementioned shortcoming and others.

SUMMARY

Responsive to the foregoing challenges, the instant disclosure provides various embodiments of systems for combined engine braking and EEVO lost motion valve actuations, as well as engine control systems and methods for utilizing engine braking and EEVO lost motion capabilities.

According to an aspect of the disclosure, there is provided, in an internal combustion engine having at least one cylinder and at least one respective exhaust valve associated with the at least one cylinder, a system for controlling motion of the at least one exhaust valve, comprising: a main event motion source associated with each of the at least one cylinder for providing main event motion to the respective at least one exhaust valve; an early exhaust valve opening (EEVO) motion source associated with each of the at least one cylinder for providing EEVO motion to the associated at least one exhaust valve; a main event valve train associated with each of the at least one cylinder for conveying main event motion and EEVO motion to the associated at least one exhaust valve; an EEVO lost motion component in at least one of the main event valve trains and adapted to absorb EEVO motion from the EEVO motion source in a first operational mode and adapted to convey EEVO motion from the EEVO motion source in a second operational mode; a braking motion source, separate from the main event motion source, associated with each of the at least one cylinder for providing braking event motion to the associated at least one exhaust valve; and a braking event valve train, separate from the main event valve train, associated with each of the at least one cylinder for conveying braking motion from the braking motion source to the associated at least one exhaust valve.

According to another aspect of the disclosure, there is provided a method of controlling operation of one or more exhaust valves in an internal combustion engine, the internal combustion engine including a main event motion source; an early exhaust valve opening (EEVO) motion source; a main event valve train for conveying main event motion and EEVO motion to the one or more exhaust valves; an EEVO lost motion component in a valve bridge in the main event valve train; a braking motion source, separate from the main event motion source, and a braking event valve train, separate from the main event valve train, for conveying braking motion from the braking motion source to the associated at least one exhaust valve, the method comprising: activating the EEVO lost motion component to absorb motion from the EEVO motion source in a first operational mode; and deactivating the EEVO lost motion component to convey EEVO motion from the EEVO motion source to the one or more exhaust valves in a second operational mode.

According to one example implementation, a combined braking and EEVO lost motion system may generally comprise a braking subsystem and an EEVO lost motion subsystem assigned to each of one or more cylinders in an internal combustion engine. Each EEVO lost motion subsystem may include a valve bridge spanning a pair of exhaust valves and a hydraulically-actuated lost motion element disposed at the interface of the valve bridge and a main event exhaust rocker arm. A cam used to drive the main event rocker arm may comprise a main event cam lobe and an EEVO event cam lobe. The lost motion element may comprise a piston slidably disposed in a bore in the valve bridge. The piston may be biased out of the bore and include an interior chamber open to the central bridge bore and an opening to permit the flow of pressurized hydraulic control fluid received from a swivel foot assembly. The bridge may include a check valve to prevent flow (and facilitate release) of control fluid. The piston and bore in the valve bridge may be configured such that the piston may slide a short distance, substantially equal to a lash space to be provided in the main event valve train, after which it makes solid contact with the bottom of the bore. In a first mode of operation, the piston is free to slide up to the point the piston bottoms out in the bore and is thus able to "lose" or absorb the EEVO event motion while transmitting main event motion. In a second mode of operation, the interior chamber of the piston is charged with hydraulic fluid that is locked within the interior chamber and bore the check valve. In this mode, all events provided by the cam, including EEVO events provided by the EEVO motion source, are transmitted via the valve bridge to the exhaust valves. A reset feature on the EEVO lost motion subsystem may be provided to reset the lost motion element at an advantageous time in the engine cycle. A reset pin extending into the valve bridge is adapted to release hydraulic control fluid from within the valve bridge and thereby collapse the lost motion element to prevent late closure of the exhaust valve. The braking subsystem may include a dedicated braking cam and a brake rocker arm and other components for each of the one or more cylinders. The components of the braking subsystem may be dedicated strictly for the purpose of providing braking or other auxiliary valve actuation motions, separately from the EEVO lost motion subsystem. The combined braking and EEVO lost motion system provides capabilities for both engine braking and EEVO events that are advantageous in terms of cost, ease of manufacture and ease of installation and adaptability to internal combustion engines, particularly HDD engines.

According to another example implementation, the combined braking and EEVO lost motion capabilities of the example systems may be used to implement advantageous control strategies for controlling engine parameters that affect emissions and other operating characteristics in a multiple cylinder internal combustion engine. These control strategies may control or modulate an engine parameter, such as exhaust temperature, aftertreatment temperature, engine load, engine torque, or engine speed. An engine controller may be communicatively associated with the combined braking and EEVO systems for each of at least one cylinders in a multiple cylinder engine and may receive input from sensors associated with the engine parameter to be controlled. The engine controller may operate and control one or more control valves, such as high-speed solenoid valves, which may each control one or more EEVO motion and braking subsystems associated with one or more cylinders. Mapping of the control valves to the cylinders may be symmetric or asymmetric to achieve various levels of engine heating or control of other engine parameters. The control strategies may involve duty cycling of one or more of the control valves and associated EEVO devices to achieve finer levels of control of engine heating or other engine parameters. Control strategies may also involve braking activation on select cylinders, control of fuel feed to select cylinders, limiting or activating EEVO based on EGR functions associated with selected cylinders, and transient operation of turbochargers.

According to another example implementation, a single valve bridge brake may be utilized in a combined braking and EEVO lost motion system. A master piston is configured with sufficient lash space to lose EEVO motions when a master piston/slave piston circuit is not charged with hydraulic fluid. When this circuit is charged with hydraulic fluid, extension of the master piston out of the central bore takes up the lash space, thereby enabling the master piston to pick up the EEVO motions in the main event rocker. The master piston/slave piston circuit is used to convey the EEVO motions to only the slave piston only to the non-braking exhaust valve. A reaction post assembly may be provided to maintain the valve bridge in horizontal alignment. Reset may be achieved through the use of a reset hole in communication with the slave piston bore. During the EEVO event, the reset hole remains closed/covered by the reaction post thereby maintaining the hydraulic lock between the master piston and slave piston. When the master piston bottoms out within the central bore during the main event, the valve bridge is moved out of contact with the reaction post permitting rapid evacuation of the master piston/slave piston hydraulic circuit, preventing overextension and late closing of the EEVO exhaust valve.

Other aspects and advantages of the disclosure will be apparent to those of ordinary skill from the detailed description that follows and the above aspects should not be viewed as exhaustive or limiting. The foregoing general description and the following detailed description are intended to provide examples of the inventive aspects of this disclosure and should in no way be construed as limiting or restrictive of the scope defined in the appended claims.

DESCRIPTION OF THE DRAWINGS

The above and other attendant advantages and features of the invention will be apparent from the following detailed description together with the accompanying drawings, in which like reference numerals represent like elements throughout. It will be understood that the description and embodiments are intended as illustrative examples according to aspects of the disclosure and are not intended to be limiting to the scope of invention, which is set forth in the claims appended hereto. In the following descriptions of the figures, all illustrations pertain to features that are examples according to aspects of the instant disclosure, unless otherwise noted.

FIGS. 10.1, 10.2 and 10.3 are schematic illustrations of an engine temperature/heat level control system using selective activation of EEVO components in an EEVO lost motion subsystem.

FIGS. 11.1 and 11.2 are schematic illustrations of an engine temperature/heat level control system using asymmetric assignment of control valves for selective activation of EEVO components in an EEVO lost motion subsystem.

FIGS. 12.1 and 12.2 are schematic illustrations of another engine temperature/heat level control system using asymmetric assignment of control valves for selective activation of EEVO components in an EEVO lost motion subsystem.

FIGS. 13.1 through 13.3 are schematic illustrations of an engine temperature/heat level control system using duty cycling of control valves for activation of EEVO components in an EEVO lost motion subsystem.

DETAILED DESCRIPTION

Figure 1:
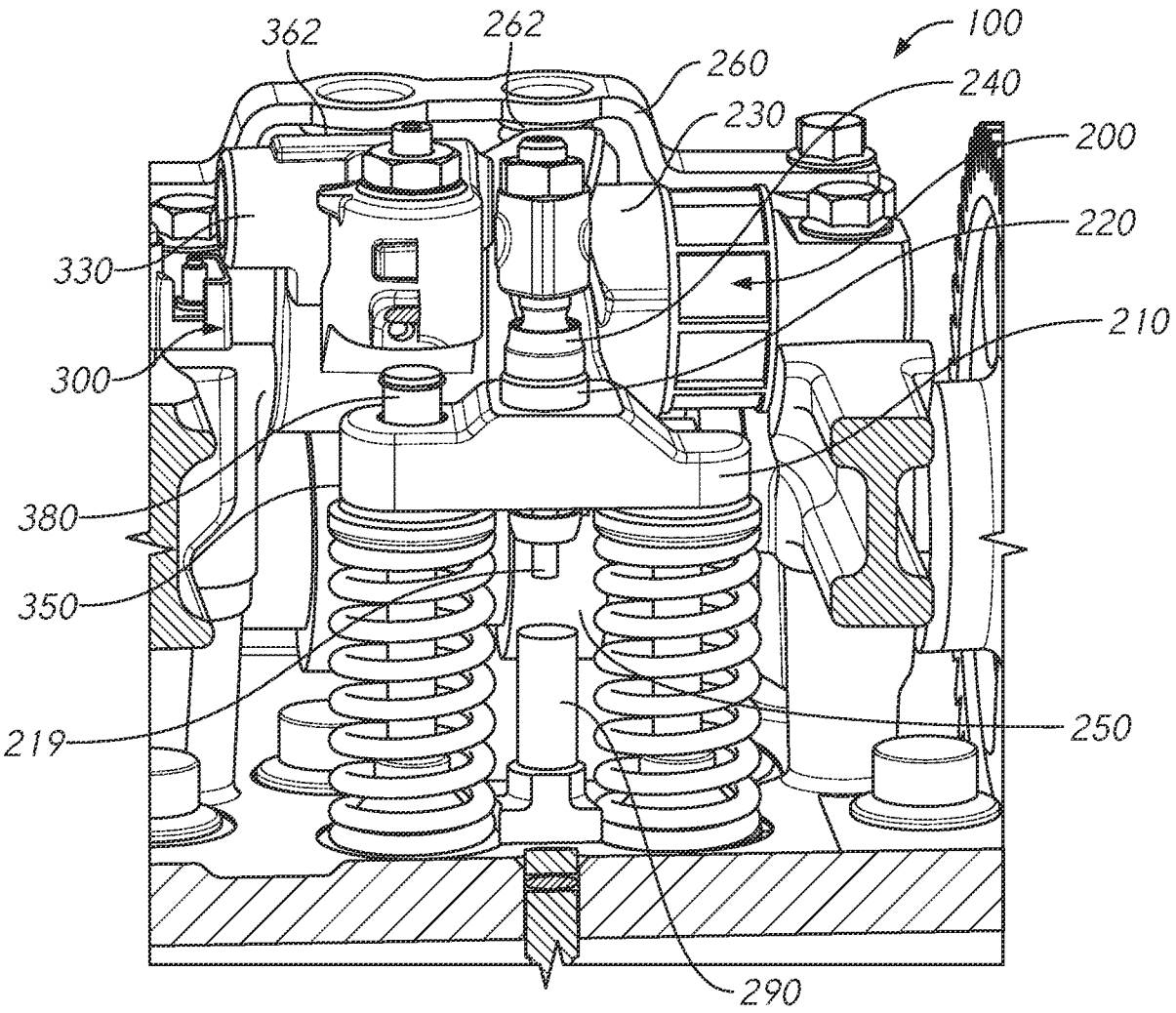
FIG. 1 is a pictorial illustration of a combined engine braking and EEVO lost motion system.

The shortcomings in the prior art noted above, and others are addressed through aspects of the instant disclosure, which provides a system that combines and integrates an engine braking subsystem, for providing engine braking to exhaust valves in an internal combustion engine, and an EEVO lost motion subsystem, for providing lost motion modification of the main event exhaust valve actuations to add EEVO events. In particular, and as illustrated in FIG. 1, the inventive system may utilize aspects of a lost motion valve bridge assembly of the type described in U.S. Pat. No. 7,905,208 ("the '208 patent"), as well as aspects of a dedicated brake rocker arm of the type described in U.S. Pat. No. 8,851,048 ("the '048 patent"). The subject matter and disclosures of each of these patent documents are incorporated by reference herein in their entirety.

FIGS. 1-6 illustrate an aspects of an example combined braking and EEVO lost motion system according to aspects of the disclosure. As shown in FIG. 1, the example combined braking and EEVO lost motion system 100 may generally comprise a braking subsystem 300 and an EEVO lost motion subsystem 200. It will be understood from the instant disclosure that the components illustrated in the example of FIGS. 1-6, described in the context of a single engine cylinder, may be replicated, in whole or in part, across one or more other cylinders in a multiple cylinder internal combustion engine. In such a case, the term "braking subsystem" may refer to all of the braking control components across the multiple cylinders. Similarly, the term "EEVO lost motion subsystem" in such a case may refer to all of the EEVO control components across the multiple cylinders.

Figure 3:
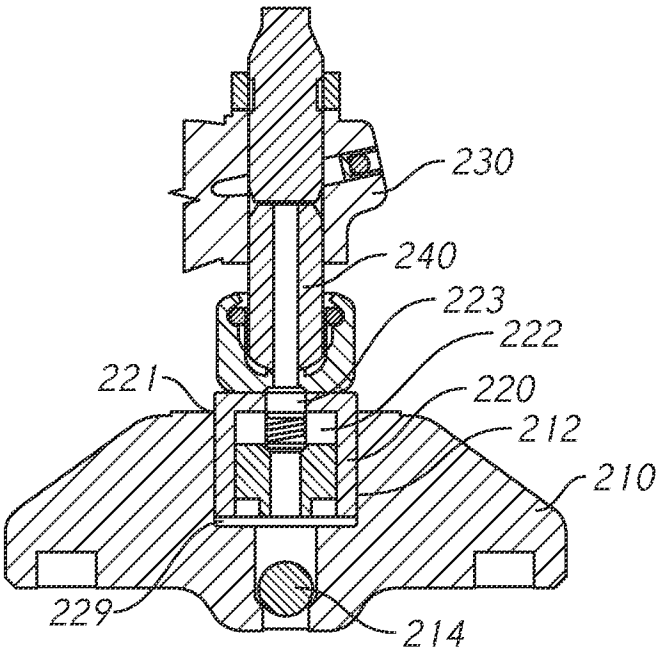
FIG. 3 is a cross-section of an example alternative lost motion valve bridge that may be used with the EEVO lost motion subsystem components of FIG. 2.
Figure 2:
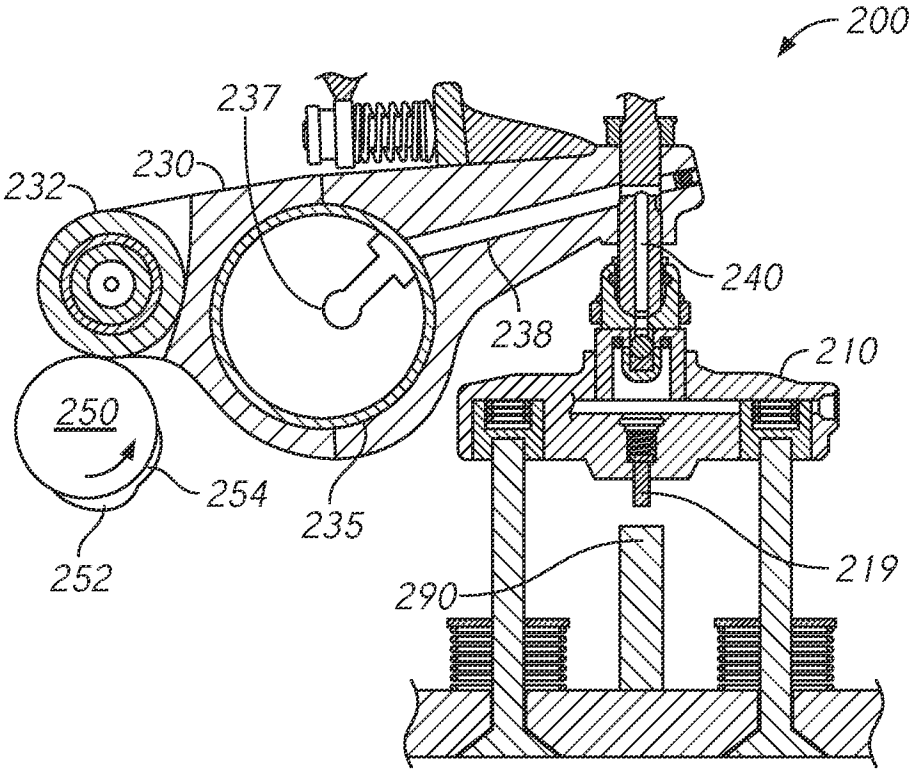
FIG. 2 is a cross-section of example components of an EEVO lost motion subsystem.

FIGS. 2 and 3 illustrates example details of a rocker arm and cam suitable for accomplishing aspects of the disclosure. It will be understood by those of ordinary skill that the valve bridge configurations illustrated in these figures are provided to illustrate example associated lost motion elements that may be utilized in accordance with aspects of the disclosure. As will be further understood, the valve bridges illustrated in these figures may be modified to include a bridge pin (380; FIG. 1) to provide for the braking functions described further herein. The EEVO lost motion subsystem 200 may include a valve bridge 210, which spans a pair of exhaust valves and additionally comprises a hydraulically-actuated lost motion element 220 disposed at the interface of the valve bridge 210 and a main event exhaust rocker arm 230. A spring bar 260 or similar device, which may engage and retain a spring 262, which engages an end of the rocker arm 230 opposite the valve bridge 210, may be provided to bias the main event exhaust rocker arm 230 into contact with a motion source, 250 i.e., a rotating cam. Referring additionally to FIG. 2, which illustrates an example environment having an alternative rocker biasing configuration that may be used, the cam 250 used to drive the main event rocker arm 230 may comprise a main event motion source, such as a main event cam lobe 252 and an EEVO event motion source, such as an EEVO cam lobe 254. These motion sources may engage a cam roller on the rocker arm 230, which is pivotably mounted to a rocker shaft 235 having one or more hydraulic fluid channels or passages 237 therein for supplying control fluid to the lost motion element 220 via a rocker passage 238, which constitutes a control fluid path, in the rocker arm 230.

Referring additionally to FIG. 3, which illustrates a cross-section of a lost motion assembly that may be used in place of the assembly illustrated in FIG. 2, the lost motion element 220 may comprise a piston 221 slidably disposed in a bore 212 centrally located in the valve bridge 210. The piston may be biased out of the bore 212 via a suitable resilient element such as a spring. The piston comprises an interior chamber 222 open to the central bore and an opening 223 to permit the flow of pressurized hydraulic control fluid received from a swivel foot assembly 240 having a passage 242 and extending from the rocker arm 230. The bridge 210 may include a check valve 214 adapted to prevent flow (and facilitate release) of control fluid from the bridge 210 and interior chamber 222. The piston 221 and bore 212 in the valve bridge are configured such that the piston 221 may slide a short distance, substantially equal to a lash space 229 to be provided in the main event valve train, after which it makes solid contact with the bottom of the bore 212. The hydraulic pressure supplied to the piston interior chamber 222 causes the piston 221 to extend and apply an upward force against the swivel foot assembly 240. The check valve (ball) 214 may be acted upon by a reset pin (not shown) which operates to unseat the check valve at a desired position of the valve bridge, similar to the function provided by the contact post 290 and reset pin 219 described above with regard to FIG. 2.

Thus, in a first mode of operation, when the interior chamber 222 of the piston 221 and bore 212 are not charged with hydraulic fluid, the piston is free to slide into the bore up to the point the piston bottoms out in the bore 212. By selecting the lash space provided by the piston/bore to be substantially equal to the maximum motion that would otherwise be provided by the EEVO event on the cam 250, the piston 221 is able to "lose" or absorb the EEVO event motion in this mode of operation. However, because the main event lobe 252 on the cam 250 provides motion larger than the lash space 229, bottoming out of the piston 221 within the bore 212 permits exhaust main events to be conveyed via the valve bridge 210 to the exhaust valves. On the other hand, in a second mode of operation, the interior chamber 222 of the piston 221 is charged with hydraulic fluid that is locked within the interior chamber and bore (aside from normal leakage) by the check valve 214. As a consequence, the piston 221 is fully extended from the bore 212 in this mode such that all events provided by the cam, including EEVO events, are transmitted via the valve bridge 210 to the exhaust valves. As will be recognized, according to aspects of the disclosure, an additive motion system is provided in which the hydraulic charging of the EEVO lost motion subsystem may add motion to the main event motion to achieve EEVO operation.

Figure 4:
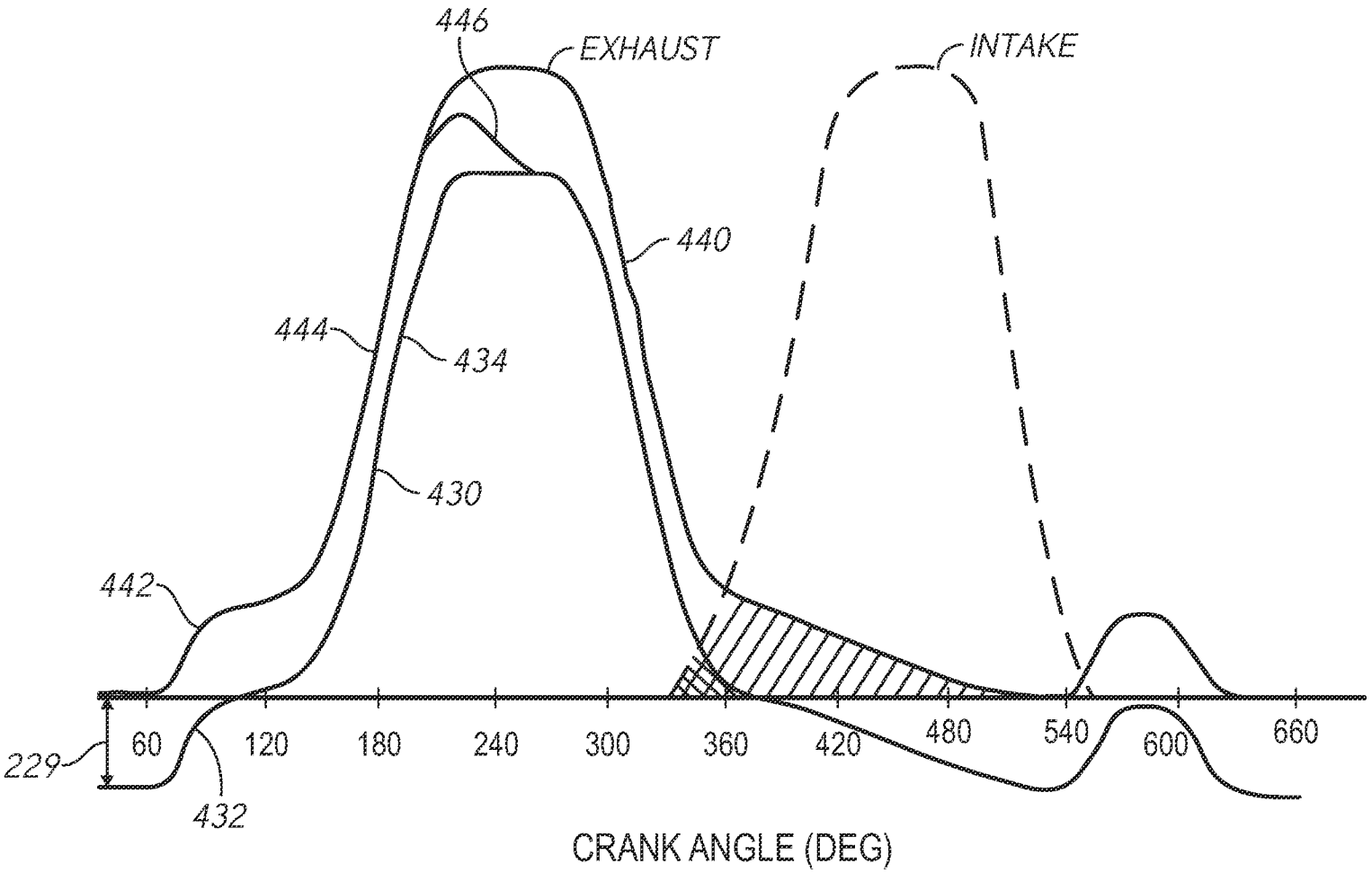
FIG. 4 is a graphical representation of modes of operation of an EEVO lost motion subsystem.

FIG. 4 is a graphical representation of exhaust valve lifts according to the two above-described modes of operation. In particular, in the first mode, the valve lift profile represented by the lower curve 430 are applied to the exhaust valve(s), with an initial EEVO lift profile 432 preceding a main event lift profile 434. As will be recognized, with the EEVO lift profile being below the horizontal axis, the EEVO event is lost due to the presence of lash space, 229, provided by the lost motion element 220 (FIGS. 1 and 3). In the second mode, the valve lift profiles represented by the upper curve 440 are applied to the exhaust valve(s), with the initial EEVO lift profile 442 preceding a main event lift profile 444. In this second mode, the EEVO event is added as the lash space 229 is eliminated by activation (i.e., hydraulic charging) of the lost motion element 220 (FIGS. 1 and 3), resulting in the exhaust valve lift represented by the upper curve 440, including the EEVO event 442, to be applied the exhaust valve(s).

A reset feature on the EEVO lost motion subsystem may be provided to reset the lost motion element at an advantageous time in the engine cycle. As illustrated in FIG. 4, if the lost motion element 220 remains in its extended state for the duration of the EEVO and main events, the main event will have a late exhaust valve closing, which may not be desirable. To address this, referring to FIGS. 1 and 2, the EEVO lost motion subsystem 200 may be provided with a reset contact post 290 extending from the cylinder head or engine block, and a reset pin 219 extending into the valve bridge 210 and adapted to release hydraulic control fluid from within the valve bridge 210 and thereby collapse the lost motion element 220. This operation may be similar to that described in the '208 patent. In the second mode, as the main event valve actuation motions cause the valve bridge 210 to be moved downward, the reset pin 219 will be brought into contact with the reset contact post 290. As the bridge 210 continues to move downward, the reset contact post 290 may unseat the reset pin 219, thereby permitting the hydraulically locked fluid in the inner chamber/central bore 212 to escape and further permitting the piston 221 to once again travel within the bore 212 until it bottoms out. In this manner, and with reference to FIG. 4, the main event lift profile 444 may transition to a reset profile 446 and then to the lower curve 430 with the phase of the main event effectively being shifted from the upper curve 440 to the lower curve 430 shown in FIG. 4, thereby permitting early opening of, but preventing late closure of, the exhaust valve(s).

Figure 6:
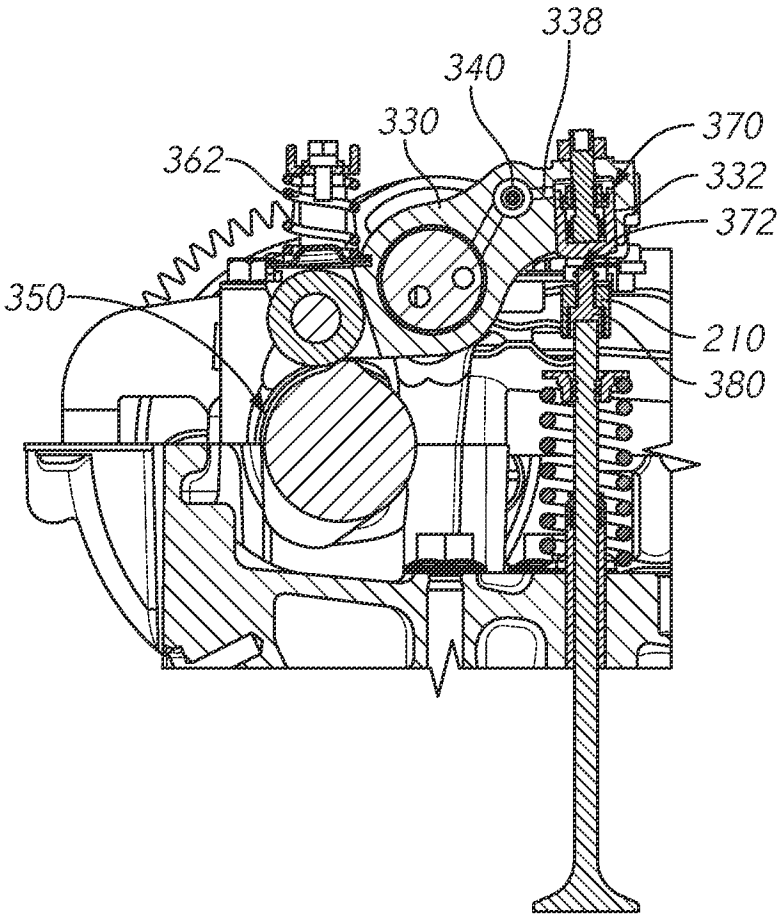
FIG. 6 is a cross-section of the engine braking subsystem of FIG. 5.
Figure 5:
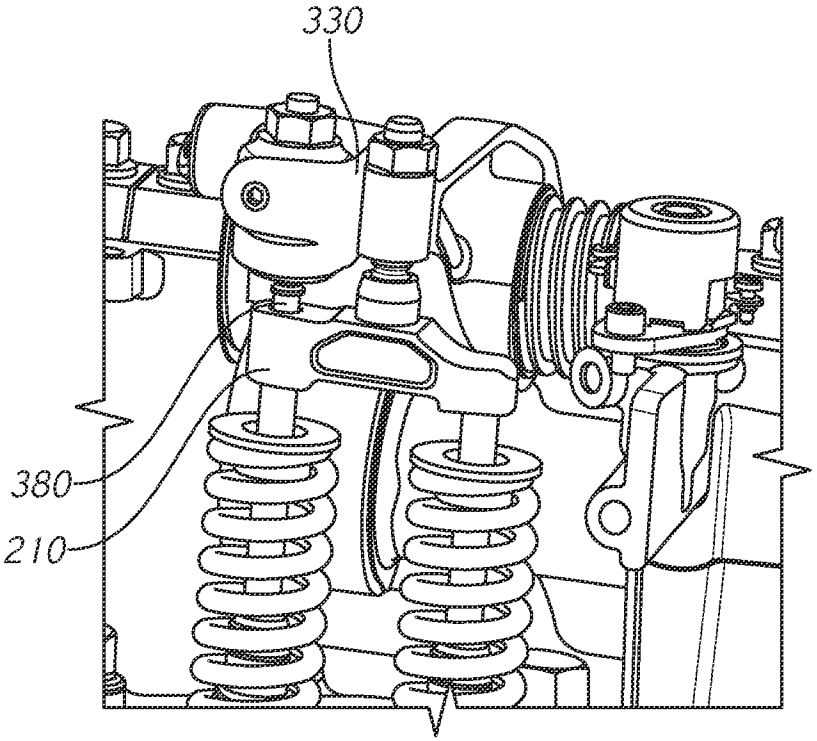
FIG. 5 is a pictorial illustration of an engine braking subsystem that may be used in combination with an EEVO lost motion subsystem, such as that shown in FIG. 2

Referring again to FIG. 1, and additionally to FIGS. 5 and 6, according to aspects of the disclosure, the combined braking and EEVO lost motion system 100 may include a braking subsystem 300, which may include a dedicated brake event motion source (i.e., braking cam) 350 and valve train, including a brake rocker arm 330 and other components) for each of one or more cylinders. The brake rocker arm 330, also termed a dedicated brake rocker arm, may receive valve actuation motions from a separate valve actuation motion source, e.g., braking cam 350, which is separate from the EEVO lost motion cam 250 (FIGS. 1 and 2) and dedicated strictly for the purpose of providing braking or other auxiliary valve actuation motions, such as compression-release engine braking valve actuation motions, to one or more exhaust valves. Like the main event rocker arm 230 (FIGS. 1 and 2), the brake rocker arm 330 may be biased into contact with its valve actuation motion source with spring bar 260 and a dedicated biasing spring 362 or similar device.

As described in the '048 patent, the brake rocker arm 330 may comprise a hydraulically controlled actuator piston assembly 370 in the nose of the rocker arm 330, i.e., the motion-imparting end of the rocker arm 330. In an embodiment, the actuator may comprise a bore 332 in the brake rocker arm 330 and a piston 372 disposed within and biased into the bore. The bore is configured to receive hydraulic fluid via a passageway 338 formed in the rocker arm 330. Additionally, a control valve 340 may be provided in the rocker arm 330 to either supply and lock hydraulic fluid with the passageway and bore, or to release the hydraulic fluid in the passageway/bore and prevent the further supply thereto. When auxiliary valve actuation is not desired, no hydraulic fluid is provided to the actuator thereby allowing the piston 372 to retract within the bore. On the other hand, when auxiliary or braking valve actuation is desired, hydraulic fluid is provided to the actuator 370 thereby causing the piston 372 to be extended out of the bore.

As further shown in FIGS. 1, 5 and 6, the brake rocker arm 330 is positioned to contact a braking actuation or bridge pin 380 disposed in the valve bridge 210 and aligned with one of the exhaust valves. Thus, when the actuator 370 is not extended, any motion applied to the brake rocker is lost by virtue of the lash space provided between the piston and the bridge pin 380. On the other hand, when the actuator 370 is extended (and hydraulically locked in the extended position), the piston 372 is brought into contact with the bridge pin 290 such that motions received by the brake rocker arm 330 are transferred to the bridge pin 290 and exhaust valve.

Configured in this manner, the system illustrated in FIG. 1 provides a relatively simple and inexpensive solution to providing both engine braking and EEVO events, particularly in HDD engines.

It is noted that, while the system in FIG. 1 may rely on a fixed EEVO valve lift profile, which could otherwise limit the flexibility to control such a system, engine control processes provided in accordance with aspects of the disclosure may be utilized to provide flexibility in controlling one or more engine parameters. For example, at low engine loads, it may be desirable to have earlier EEVO timing to achieve the desired temperature output as compared to higher engine loads. On the other hand, EEVO events with early timing implemented during periods of relatively higher engine loads may result in excessive temperature and fuel consumption. To broaden the efficient operating range, the system illustrated in FIG. 1 can be configured with early timing and a modular control strategy for temperature management. As described below, the modular control strategy applies EEVO operation on the cylinders as needed for optimum fuel consumption, i.e., less than the full number of cylinders can be activated to provide EEVO.

Figure 7:
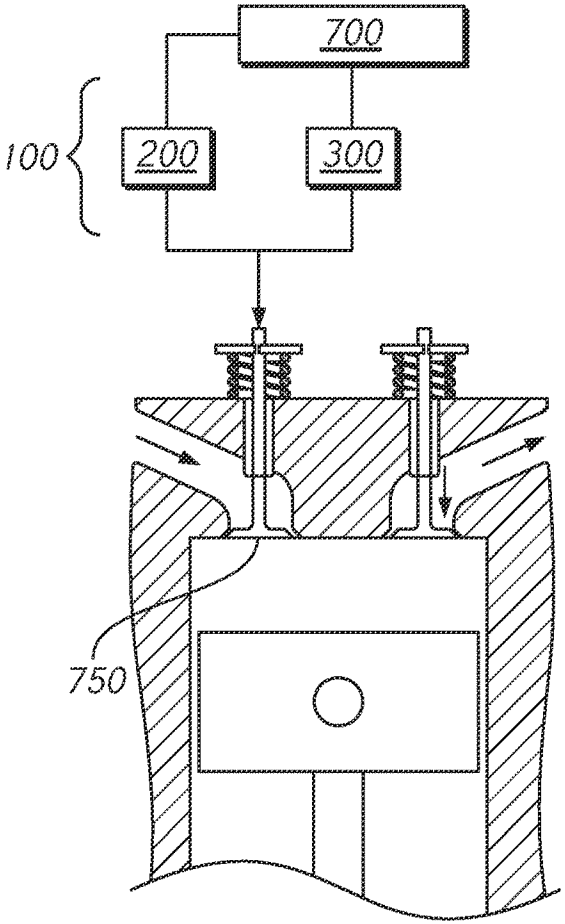
FIG. 7 is a schematic diagram of control components for a combined engine braking and lost motion system operating on one or more exhaust valves associated with an engine cylinder.

According to aspects of the disclosure, the combined braking and EEVO lost motion capabilities provided by the systems such as those described above may be used to implement advantageous control strategies in an internal combustion engine. FIG. 7 is a schematic block diagram including a cross-sectional view of an engine cylinder and illustrating control components suitable for implementing the control strategies using combined braking and EEVO lost motion systems disclosed herein.

Figure 8:
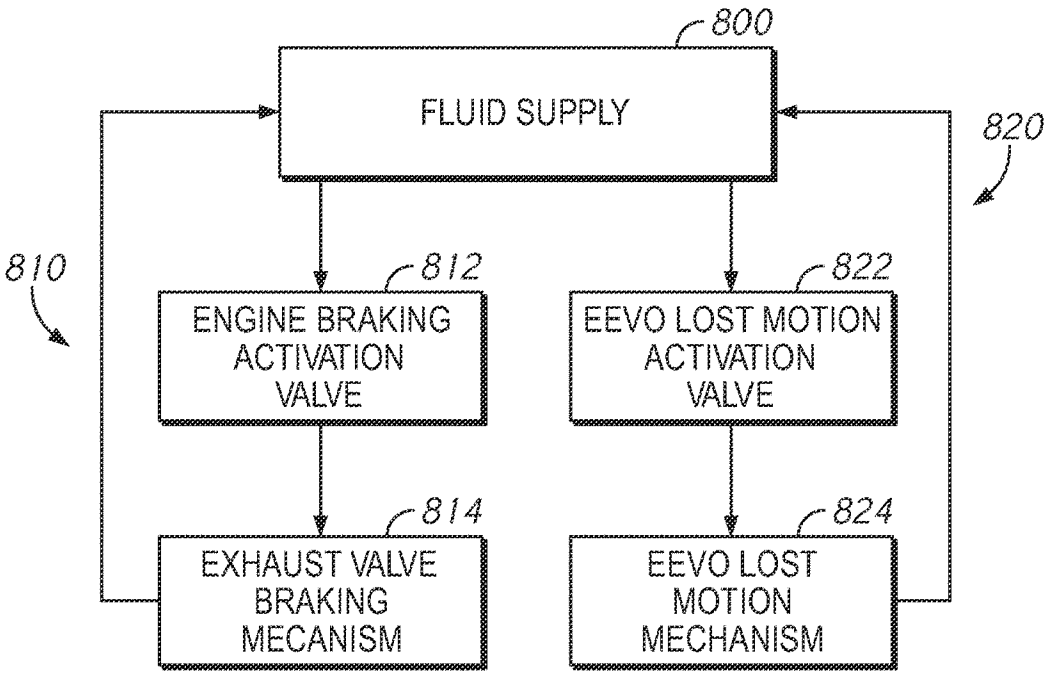
FIG. 8 is a schematic block diagram of hydraulic control components and hydraulic circuits for a combined engine braking and lost motion system.

FIG. 8 is a schematic block diagram of an example hydraulic system for actuating braking and EEVO lost motion valve events using the engine braking mechanisms and EEVO lost motion mechanisms described above. A control fluid supply 800 may feed an engine braking mechanism activation hydraulic circuit 810 and an EEVO lost motion activation hydraulic circuit 820. These circuits may be implemented using the rocker shaft passages, rocker arm passages and other fluid conduits, passages and paths described above. An engine braking activation valve 812, which may include a high-speed solenoid valve, may control flow to an exhaust valve braking mechanism 814 for activation thereof. Fluid returns to the fluid supply 800 after flow thru the exhaust valve engine brake mechanism 814. An EEVO lost motion activation valve 822 may control flow to an exhaust valve EEVO lost motion mechanism 824. Fluid returns to the fluid supply 800 after flow thru the exhaust valve EEVO lost motion mechanism 824. As will be understood from the instant disclosure, the hydraulic system may be replicated for each cylinder, or a subset of cylinders, in a multiple cylinder engine environment. As will be understood, the functions of the valves 812 and 822 are separately controlled, for example with separately controlled solenoid valves. Moreover, engine braking activation valves 812 and EEVO lost motion activation valves may be provided as respective valves for each cylinder, or may be provided as a single valve controlling events on two or more cylinders, as will be described.

Figure 9:
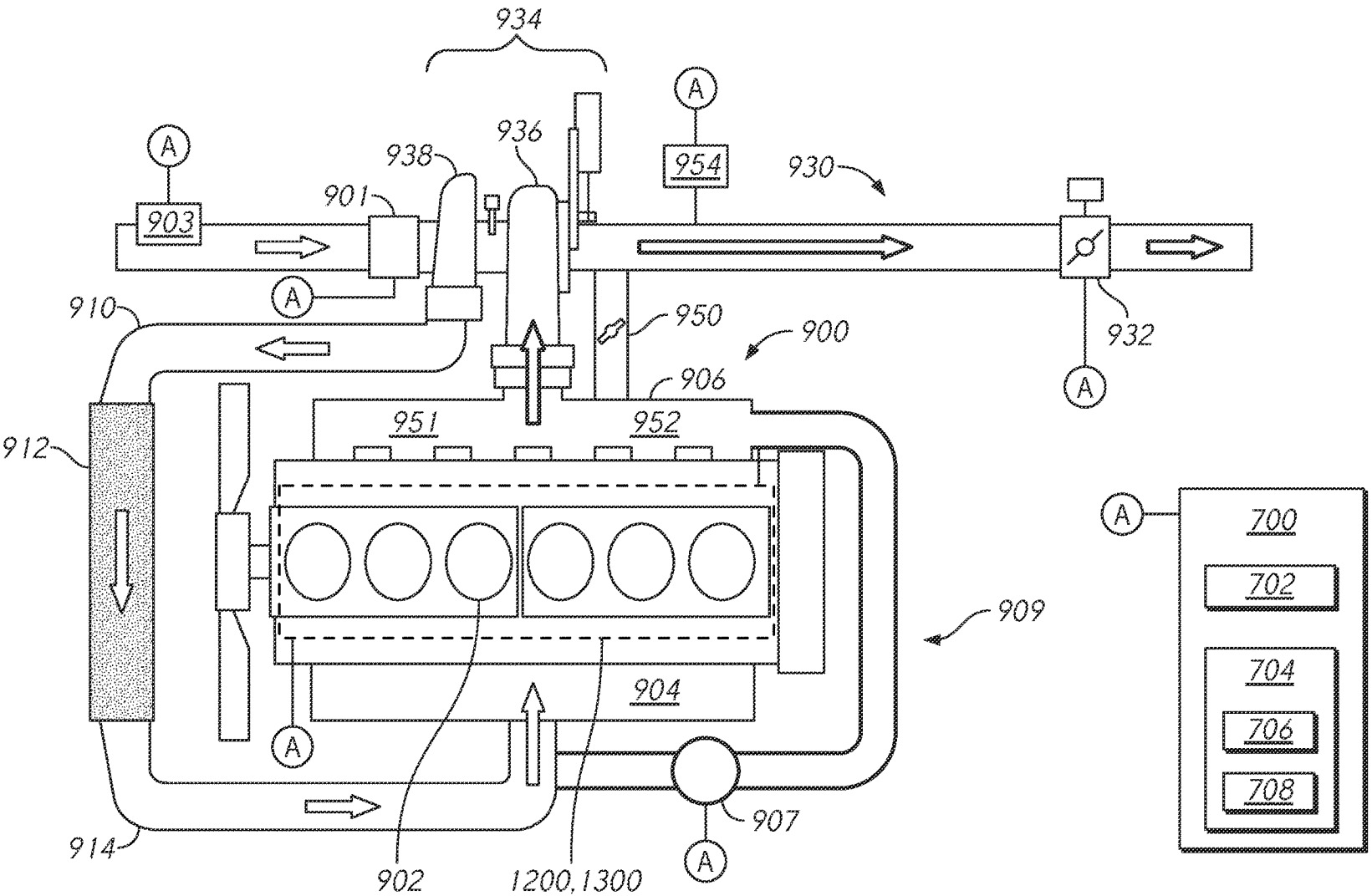
FIG. 9 is a schematic diagram of an engine environment for implementing control of engine parameters using a combined engine braking and EEVO lost motion system.

Referring additionally to FIG. 9, an internal combustion engine 600 is shown operatively connected to a number of other engine support subsystems and components that may be utilized for controlling or modulating an engine parameter using the braking and EEVO capabilities describe above, in accordance with aspects of the present disclosure. The internal combustion engine 900 may comprise a plurality of cylinders 902, an intake manifold 904 and an exhaust manifold 906. Exhaust manifold 906 may be divided with forward cylinders 1-3 having an exhaust manifold section 951 that does not have an EGR capability and rear cylinders 4-6 having an exhaust manifold section 952 that provides an EGR capability. Engine cylinders with EGR functions may provide a basis for engine parameter control in the control processes discussed herein. FIG. 9 also schematically illustrates an engine braking subsystem 1200 and EEVO lost motion subsystem 1300, each of which may comprise components described above for actuating one or more valves to achieve engine braking and EEVO lost motion according to signals provided by controller 700, for example, to solenoid or activation valve components 812, 822 (FIG. 8) for controlling engine brake valve actuation and EEVO events. The exhaust system 930 may comprise an exhaust throttle or exhaust braking subsystem 932 and a turbocharger 934. As known in the art, the turbocharger 934 may comprise a turbine 936 operatively connected to a compressor 938 in which exhaust gases (illustrated by the black arrows) output by the exhaust manifold 906 rotate the turbine 936, which in turn, drives the compressor 938. Turbocharger 934 may be a variable geometry turbocharger (VGT) permitting variation of the turbocharger geometry under control of the controller 700. The geometric variation may include variable vanes (i.e., sliding or rotating vanes) to direct airflow and/or variable nozzles having fixed vanes to direct airflow and a sliding housing to vary airflow. Furthermore, the turbocharger 934 may comprise a wastegate (internal or external) that may be used to divert exhaust gases away from the turbine 936 and directly into the exhaust system 930. The exhaust braking subsystem 932 may comprise any of a number of commercially available exhaust brakes. Exhaust system 930 may also comprise an exhaust gas recirculation (EGR) system 909 for recirculating exhaust gases to the engine intake. An EGR valve 907 may be operatively connected to the controller 700 and may be modulated in response to the controller 700 to achieve control of EGR in accordance with aspects of the disclosure. Collectively, the exhaust manifold 906, turbocharger turbine 936, exhaust system 930 and EGR system 909 may constitute an exhaust flow path. An exhaust temperature sensor 954 may be disposed in the exhaust flow path. A waste gate 950 may provide a bypass of the turbocharger turbine 936 from the exhaust manifold 906 to the exhaust flow path.

As further shown in FIG. 9, a controller 700 may be provided and may be operatively connected via the connection points referenced "A" and others in FIG. 9 to the braking subsystem 1200, EEVO lost motion subsystem 1300, and other engine subsystems and components, including the intake throttle 901, EGR valve 907, intake manifold blow off valve 903, turbocharger 934 and engine exhaust temperature sensor 954, as examples. The circled "A" reference denotes an operative and communicative connection. In an embodiment, the connections between the controller 700 and noted components may be configured to convey signals from sensing elements, such as sensors in the exhaust manifold which generate signals to the controller 700 to provide for control and modulation of engine parameters using the braking and EEVO capabilities of the systems described above. In practice, though not illustrated in FIG. 6, the connections to the various components may be to various control elements (such as, but not limited to, integrated or external linear or rotary actuators, hydraulic control valves, etc.) used to control the respective components responsive to signals from the controller 700. In this manner, the controller 700 controls operation of these components and subsystems.

In the illustrated embodiment, the controller 700 may comprises a processor or processing device 702 coupled a storage component or memory 704. The memory 704, in turn, comprises stored executable instructions and data, which may include an engine parameter management module 706 and/or a valve actuation sequencing module 708. In an embodiment, the processor 702 may comprise one or more of a microprocessor, microcontroller, digital signal processor, co-processor or the like or combinations thereof capable of executing the stored instructions and operating upon the stored data. Likewise, the memory 702 may comprise one or more devices such as volatile or nonvolatile memory including but not limited to random access memory (RAM) or read only memory (ROM). Processor and storage arrangements of the types illustrated in FIG. 9 are well known to those having ordinary skill in the art. In one embodiment, the processing techniques described herein are implemented as a combination of executable instructions and data within the memory 704 executed/operated upon by the processor 702. As an example, the controller 700 may be implemented using an engine control unit (ECU) or the like, as known in the art.

While the controller 700 has been described as one form for implementing the techniques described herein, those having ordinary skill in the art will appreciate that other, functionally equivalent techniques may be employed. For example, as known in the art, some or all of the functionality implemented via executable instructions may also be implemented using firmware and/or hardware devices such as application specific integrated circuits (ASICs), programmable logic arrays, state machines, etc. Furthermore, other implementations of the controller 700 may include a greater or lesser number of components than those illustrated. Once again, those of ordinary skill in the art will appreciate the wide number of variations that may be used is this manner. Further still, although a single controller 700 is illustrated in FIG. 9, it is understood that a combination of such processing devices may be configured to operate in conjunction with, or independently of, each other to implement the teachings of the instant disclosure.

An example of such a modular control strategy utilizing the EEVO capabilities of the above-described systems is illustrated with reference to FIGS. 10.1, 10.2 and 10.3. In these examples, it is assumed that two separate high-speed solenoids are provided to control the flow of hydraulic fluid to the main event rocker arms in a 6-cylinder engine. In particular, a first solenoid 812.1 controls hydraulic fluid applied to the EEVO lost motion components associated with each of three (one half) of the cylinders, e.g., cylinders labeled 1-3, in FIG. 10.2, whereas a second solenoid 812.1 controls hydraulic fluid applied to EEVO lost motion components associated with each the other half of the cylinders, e.g., cylinders labeled 4-6 in FIG. 10.2. As shown in FIG. 10.2, the first solenoid could be used to activate EEVO events for cylinders 1-3 only (as indicated by the "X" mark) in order to provide a first level of heat to the exhaust system. Alternatively, both the first and second solenoids could activate EEVO for all six cylinders, thereby providing a second, higher level of heat to the exhaust system. An even finer level of control may be provided according to the strategy illustrated in FIG. 10.2 by alternating between the first and second heat levels on a duty cycle basis. For example, by continually switching between actuation of only the first solenoid for 50% of the time and actuation of both the first and second solenoids for the other 50% of the time, an average heating level between the first and second heating levels may be achieved.

In the control strategy illustrated with reference to FIG. 10.3, it is assumed that first and second solenoids are deployed as described in FIG. 10.1. In this embodiment, however, EEVO events between the cylinders are asymmetric, e.g., the EEVO events for cylinders 4-6 provide earlier opening, and therefore a longer EEVO event, as compared to the EEVO events for cylinders 1-3. Thus, to provide a first heating level, only the first solenoid is activated, thereby causing EEVO events on cylinders 1-3. A second, higher heating level may be provided by activating only second solenoid such that the earlier EEVO events for cylinders 4-6 are employed. Finally, a third, even-higher level of heating may be provided by activating both the first and second solenoids so that all six cylinders experience their respective EEVO events.

The strategy illustrated in FIG. 10.3 can be utilized to accommodate various engine load conditions. For example, early exhaust valve opening may be applied to some cylinders (e.g., cylinders 4-6 in FIG. 10.3) that will only operate at low load conditions. These cylinders may require timing near top-dead center (TDC) to achieve a rapid warmup strategy, or possibly a diesel particulate filter (DPF) regeneration strategy requiring very high heat output. On the other hand, operating with very early exhaust opening at higher loads and speeds can cause problems for excessive temperature on exhaust valves, and possible excessive loading on the valvetrain hardware. Thus, as load increases above a threshold, EEVO events for the early timed cylinders can be deactivated, and other cylinders with less advanced EEVO (e.g., cylinders 1-3 in FIG. 10.3) may be used to modulate higher load ranges if needed.

In the control strategy illustrated with reference to FIGS. 11.1 and 11.2, it is assumed that first and second solenoids, 812.1 and 812.2 are once again provided. However, in this embodiment, the distribution of the cylinders controlled by the respective solenoids is asymmetrical. In the illustrated example, the first solenoid controls only two cylinders (cylinders 1 and 2), whereas the second solenoid controls four cylinders (cylinders 3-6). Thus, to provide a relatively low heating level, only the first solenoid is activated, thereby causing EEVO events only on cylinders 1 and 2. In a middle heating level, only the second solenoid is activated, thereby causing EEVO events on twice as many cylinders as compared to the first heating level, i.e., cylinders 3-6. Once again, a third, even-higher level of heating may be provided by activating both the first and second solenoids so that all six cylinders experience their respective EEVO events. It should be noted that such "asymmetrical" strategies as described above may also be combined such that, for example, cylinders are asymmetrically distributed between solenoids and EEVO events between cylinders are not equivalent. Additionally, the use of duty cycles between heating levels, as described above, can be employed to achieve intermediate levels of heating.

Yet another control strategy is illustrated in FIGS. 12.1 and 12.2, in which three solenoids are provided with asymmetrical cylinder distribution between the solenoids, i.e., the first solenoid controls only cylinder 1, the second solenoid controls cylinders 2 and 3 and the third solenoid controls cylinders 4-6. In this manner, up to six different levels of heating may be provided by selectively activating the three different solenoids either alone or in combinations with each other such that EEVO events are selectively provided on 1, 2, 3, 4, 5 or 6 cylinders. Once again, the use of duty cycles between the six illustrated heating levels may be employed to achieve even finer grained control of heating provided to the exhaust system.

The control strategies described above with reference to FIGS. 10.1-3, 11.1-2, 12.1-2 and can be extended to the point that separate, individual EEVO control is provided to each cylinder in an engine, for example, as illustrated in FIG. 13.1, wherein a respective control valve 812.1-6 is provided for each cylinder. In such a context, the concept of duty cycles to provide desired heating levels can be extended to the level of individual cylinders in order to prevent any one or more cylinders operating hotter than the other cylinders. An example of this is illustrate in FIG. 13.2 where the cylinders are activated on a continuous, alternated pattern on a per engine cycle basis to provide EEVO heat output in a modular fashion. In this embodiment, a 50% cylinder duty cycle is provided (e.g., cylinders 2, 4 and 6 on even-numbered engine cycles and cylinders 1, 3 and 5 on odd-numbered engine cycles) such that none of the cylinders is continuously active. Continuously cycling cylinders on and off in this fashion can prevent cylinders from operating hotter than others, and can balance the engine's heat output while providing heat as needed.

Another duty cycle example is provided in FIG. 13.3, where a 25% cylinder duty cycle is provided. In this example, cylinders 2 and 6 are activated for EEVO events for engine cycle n; cylinder 3 is activated for EEVO for engine cycle n+1; cylinder 4 is activated for EEVO events for engine cycle n+2; and cylinders 1 and 5 are activated for EEVO event for engine cycle n+3. In this manner, no one cylinder implements EEVO events for more than 25% of the time.

Using any of the control strategy embodiments described above, a predetermined mapping of various speed/loading conditions of the engine to specific heating levels may be provided in a controller or ECU 700 (FIG. 9). It will be appreciated from the instant disclosure that engine parameters other than, or in addition to, speed or loading (e.g., exhaust temperature) could be employed for this purpose. Sensor inputs to the ECU can then be monitored to determine the specific operating condition of the engine to determine the best heating level, if any, to be applied to the exhaust system.

During EEVO operation of a given cylinder, the early opening exhaust allows energy to escape to the exhaust system. This energy would otherwise provide torque in the cylinder. As one or more cylinders transition to EEVO operation in accordance with any of the above-described control strategies, it may be desirable for the system to provide additional fuel to the EEVO cylinders maintain equivalent torque output. For example, a controller can provide fuel on a cycle-by-cycle basis and cylinder-by-cylinder basis to the EEVO cylinders based on an additional map of fuel injection versus torque request and engine speed. Such an EEVO map can thus compensate for any torque loss while delivering smooth power output during EEVO mode operation on less than the full number of cylinders. To further complement such a torque transition strategy, EEVO may be applied in a progressive fashion to activate less than the full number of cylinders at a time to progress from no EEVO to full EEVO over a number of engine cycles to smooth the torque transition further.

On some engines with external EGR systems, the EGR gas flow is collected from only one half of the engine, or only some cylinders. With cooled EGR systems it may not be desirable to provide EEVO operation on those cylinders contributing to EGR operation as this added heat may overload the EGR cooler with excessive heat. Operating only those cylinders not connected to the EGR loop in EEVO mode could still be beneficial in some cases. On the other hand, other situations may benefit from EEVO operation on those cylinders included in an EGR loop. For example, for rapid warmup of engine coolant it may be desirable to increase heat output into the EGR loop in some instances; thus, operation with EEVO may be desired for only those cylinders connected to the EGR loop. With uncooled EGR systems it may be advantageous for warmup to run these cylinders in EEVO mode.

There may arise situations where it is desirable to provide even greater levels of energy to the exhaust system than could otherwise be provided by EEVO events alone. To operate with the most extreme exhaust temperature possible, the engine may operate with some cylinders providing engine brake operation to produce negative torque, and other cylinders producing positive power, and at least one cylinder providing EEVO valve motion on the positive power cylinders. This provides the most extreme heat output for engine warmup, or for exhaust aftertreatment regeneration while stationary or under low loads.

It is also anticipated that EEVO operation can be used to improve transient response in positive power. That is, additional exhaust energy can power an engine's turbocharger to provide more boost pressure, and provide this boost pressure at a lower engine speed. In this scenario, at least one cylinder can be activated to provide EEVO valve motion during transients from low boost pressure to higher boost pressure. After achieving the desired boost pressure, those cylinders activated for EEVO can be deactivated (i.e., discontinue EEVO events) to allow optimum fuel economy.

Figure 14:
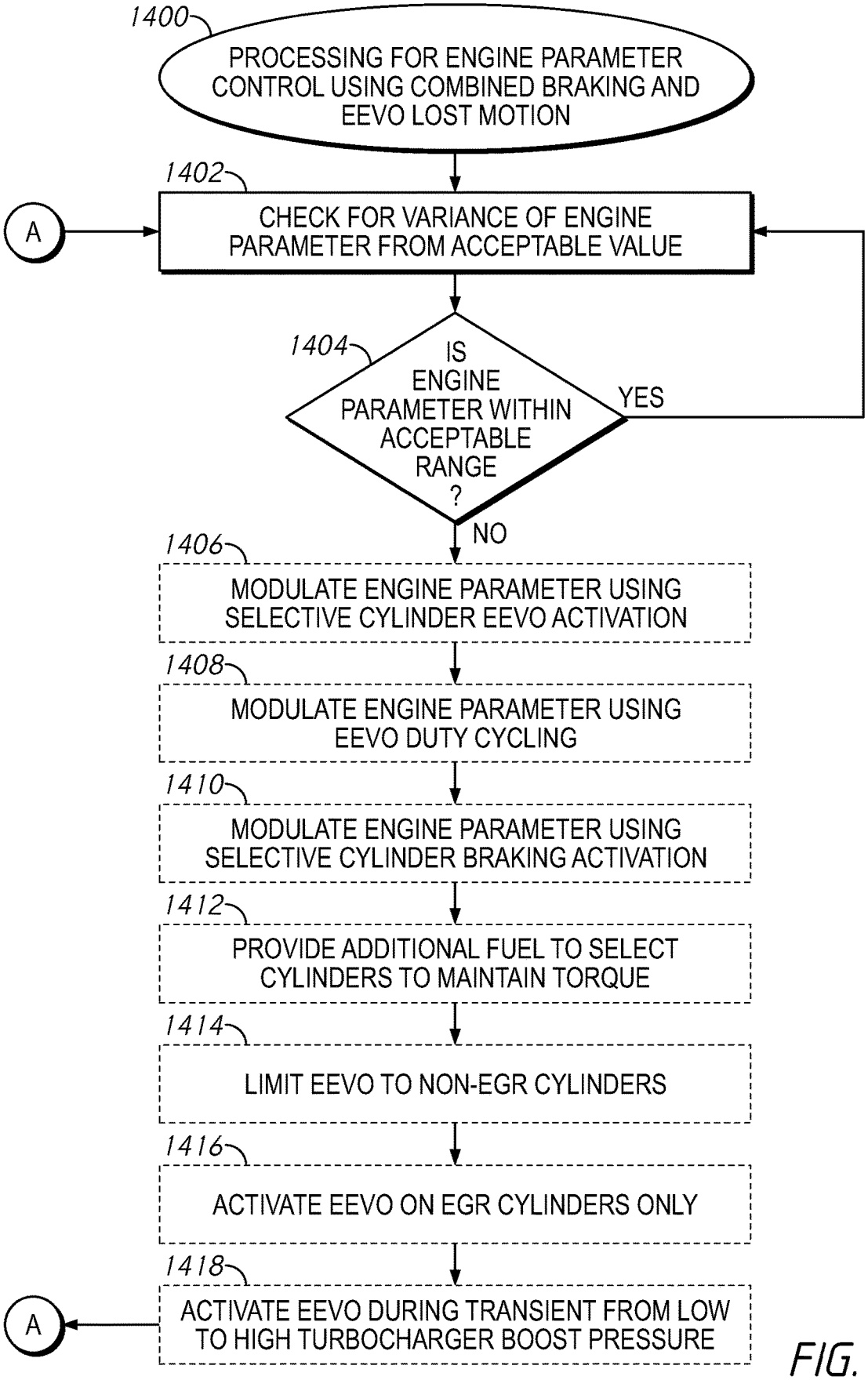
FIG. 14 is a flow diagram of processing steps for engine parameter control using a combined braking and EEVO lost motion system.

FIG. 14 illustrates example processing 1400 that may be provided by ECU 700 (FIG. 9) for controlling or modulating an engine parameter using the combined engine braking and EEVO lost motion systems according to aspects of the disclosure. At 1402, a check is made for variance of the one or more engine parameters that are sought to be controlled, which may include aftertreatment (i.e., exhaust/catalyst) temperature, engine load, engine speed or any other operating parameter that may be monitored by suitable sensors. If the engine parameter is within an acceptable or desired range, at 1404 the processing may branch back to the checking function at 1402. If the parameter is not within an acceptable range, the process may continue to a number of control functions, which are illustrated in dotted lines to indicate that they may be utilized alternatively or in any combination as part of the processing. For example, at 1406, the processing may modulate the engine parameter using selective cylinder EEVO activation, as described above, to bring the engine parameter back within an acceptable range. At 1408, the processing may modulate the engine parameter using EEVO duty cycling as described above. At 1410, the processing may modulate the engine parameter by controlling the braking event subsystem(s) associated with one or more cylinders to implement selective cylinder braking. At 1412, the processing may provide additional fuel to select cylinders to maintain torque, as described above. At 1414, the processing may limit the EEVO events to cylinders that are not involved in an EGR function. At 1416, the processing may activate EEVO events only on cylinders that are involved in an EGR function. At 1418, the processing may activate EEVO during transient periods from low to high turbocharger boost pressure.

Figure 15:
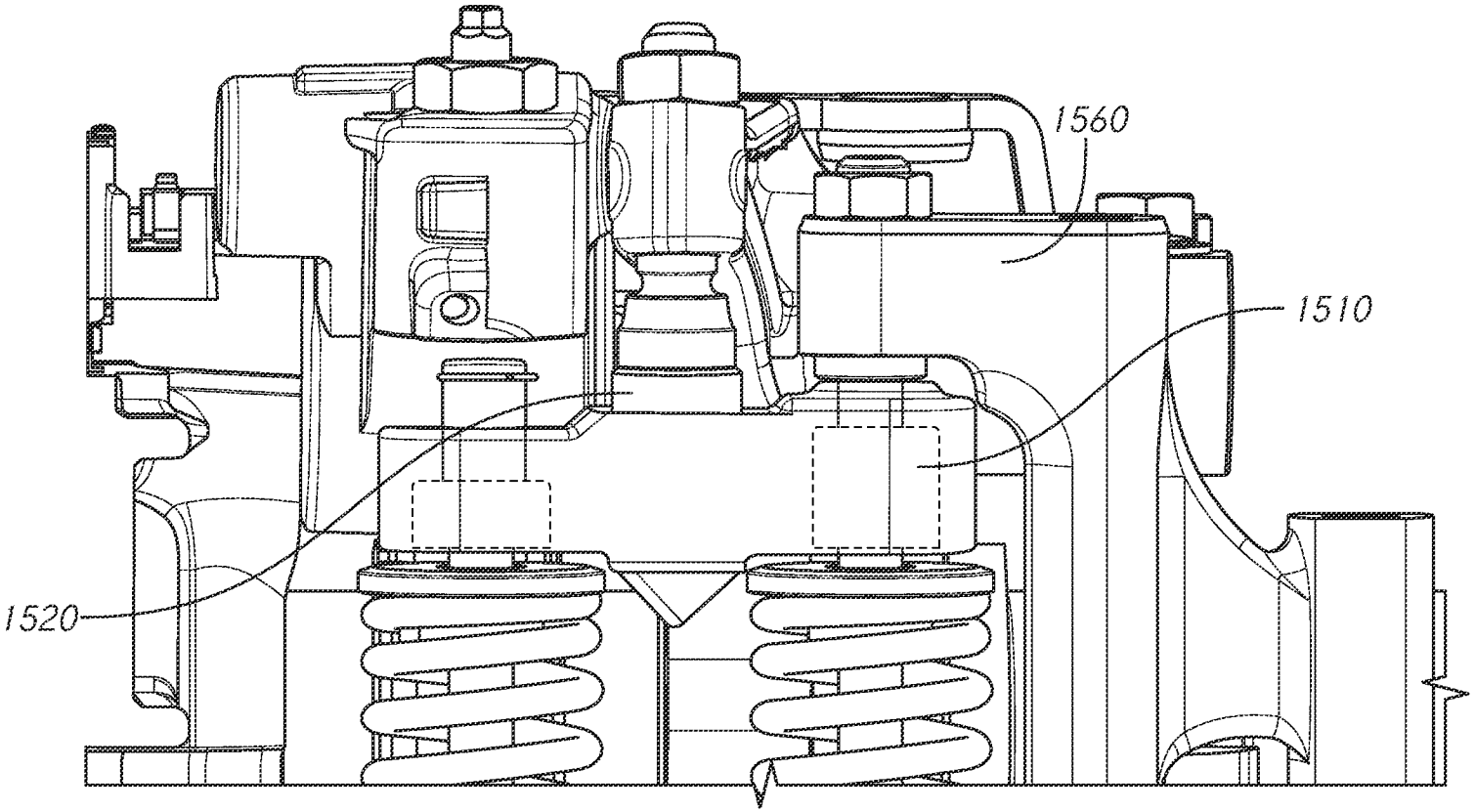
FIG. 15 is a pictorial representation of a single valve bridge brake in a combined braking and EEVO lost motion system.
Figure 16:
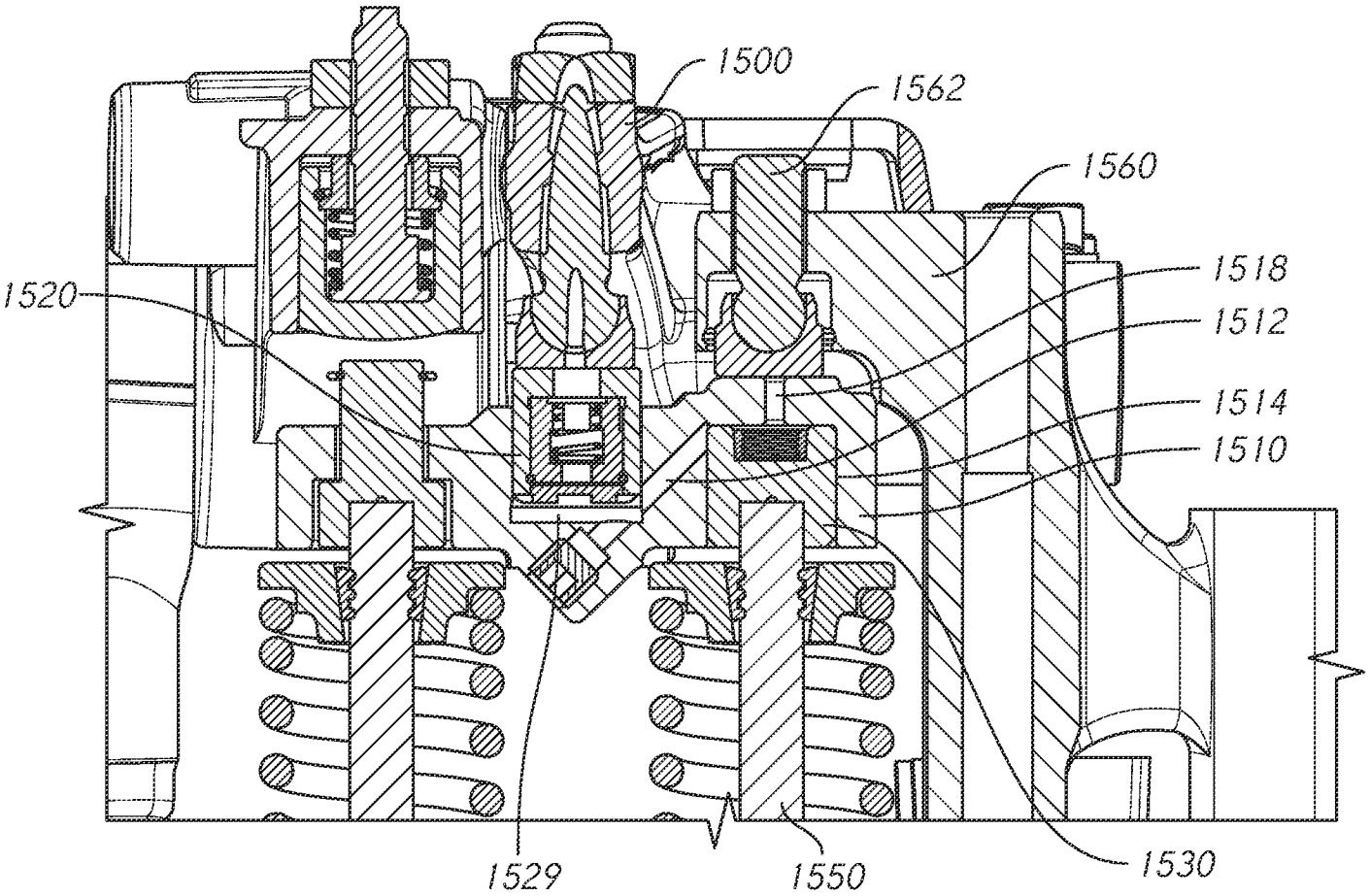
FIG. 16 is cross-section of the single valve bridge brake of FIG. 15.
Figure 17:
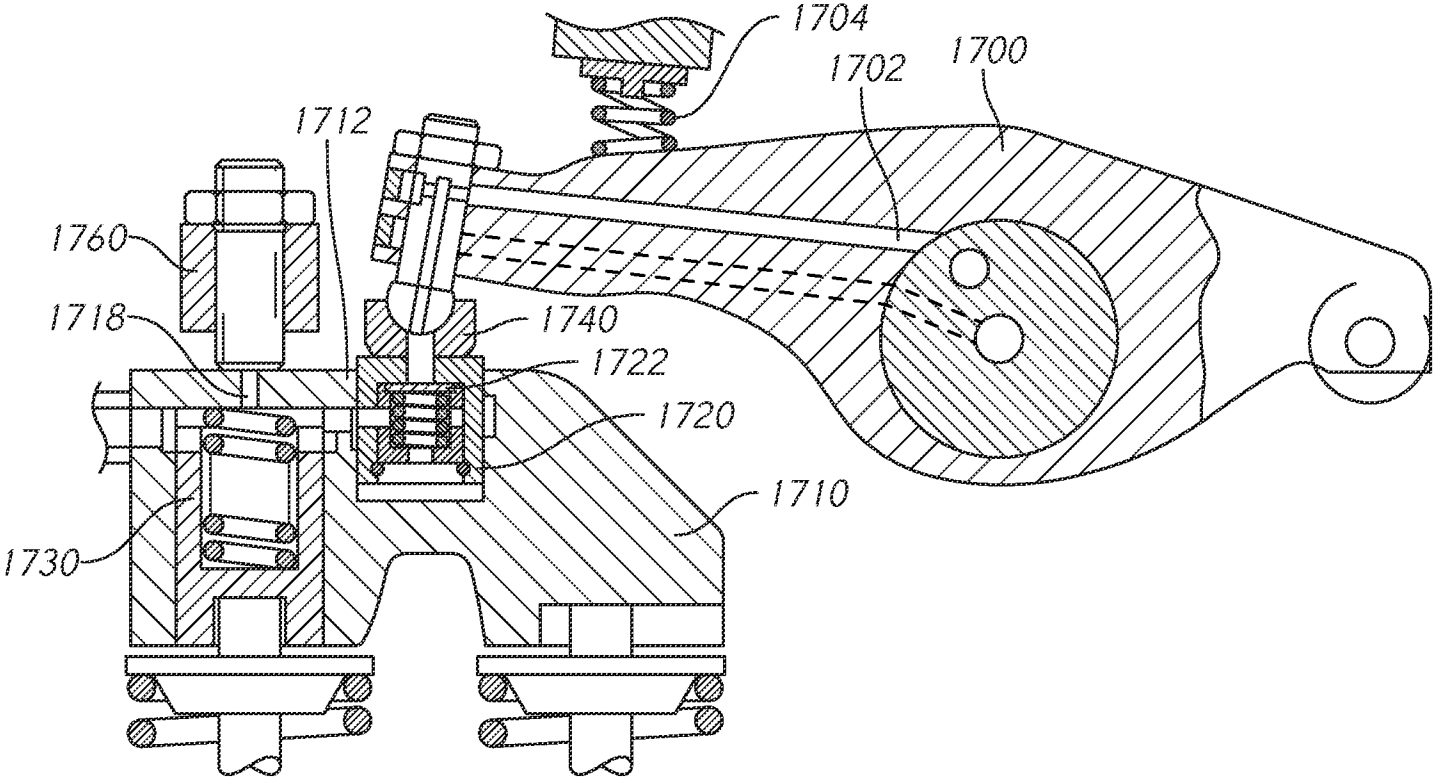
FIG. 17 is a cross-section of a single valve bridge brake, aspects of which may be used in the system of FIGS. 15 and 16.

As an alternative to the components of an engine braking subsystem illustrated in FIGS. 1-6, a so-called single valve bridge brake configuration may be employed, an example of which is illustrated in FIGS. 15-17. Aside from the differences described below, the systems of FIGS. 1-6 and the system of FIGS. 15-17 may be operated in substantially the same manner. In the embodiments utilizing aspects of a single valve bridge brake, the brake rocker arm 330 and bridge pin 380 may still be provided as described above relative to FIGS. 1-6. However, in single valve bridge brake embodiments, that portion of the valve bridge cooperating with the main event rocker arm and the other (non-braking) exhaust valve may be replaced by a bridge having features of the bridge described in U.S. Patent Application Publication No. 20100319657 ("the '657 publication"), the disclosure and subject matter of which is incorporated herein by reference in entirety. As described in the '657 publication, and as shown in FIG. 17, such valve actuation systems may include a valve bridge 1710, and a bracket or fixed member 1760, which facilitate actuation of the engine valves. A rocker arm 1700 may include an elephant foot 1740 at an end thereof. A rocker passage 1702 may extend from the rocker shaft to a passage in an adjustment screw assembly associated with the elephant foot 1740. A rocker spring 1704 may bias the rocker arm 1700 and elephant foot 1740 downward into contact with the valve bridge 1710 through a master piston 1720. The biasing force exerted on the rocker arm 1700 by the rocker spring 1704 may be large enough to prevent any "no-follows" by the valve train components, but less than the force exerted on the master piston 1720 by the low-pressure hydraulic fluid source in the rocker shaft. The bias spring in this arrangement may force the rocker off of the camshaft when EEVO is deactivated. The bias spring may also be placed on an opposite side of the rocker arm to bias it towards the camshaft. In configurations where the engine brake valve train requires a biasing arrangement that biases toward the cam, it may be preferable to provide a similar biasing arrangement on the EEVO lost motion valve train with similar biasing direction (towards the cam). This may also provide advantages in system responsiveness, since oil flow into the hydraulic components (i.e., lost motion components, bridge actuator piston) would not be countered by force of the bias spring. As a result, the elephant foot 1740 may be biased into contact with the valve bridge 1710 through the master piston 1720. The master piston 1720 may be slidably disposed in a master piston bore located in the center of the valve bridge 1710. A slave piston 1730 may be slideably disposed in a slave piston bore located over a first engine valve. A bridge passage 1712 may extend through the interior of the valve bridge 1710 and provide hydraulic communication between the master piston bore and the slave piston bore. A first check valve 1722 may be disposed in the hydraulic circuit extending between the master piston 1720 and the slave piston 1730. A bleed hole 1718 may extend from the upper end of the slave piston bore to the outer surface of the valve bridge 1710. The slave piston 1730 may include a hollow interior to permit hydraulic fluid to work against the slave piston. A spring may be disposed in the hollow interior of the slave piston 1730 to bias the slave piston towards the exhaust rocker e-foot and out of the slave piston bore. As will be recognized, this lost motion configuration may be applied with any rocker biasing configuration, including the above described configurations. A brake load screw may be held in place by a bracket or fixed member 1760 otherwise connected to the engine or engine compartment. The upper surface of the valve bridge 1710 in the region of the bleed hole 1718 may be adapted to seat against the brake load screw such that when so seated hydraulic fluid is blocked from venting through the bleed hole 1718. It is appreciated that the mating surfaces of the brake load screw and the valve bridge 1710 may be specially finished or shaped to provide a sufficiently fluid tight seal between them.

Referring now to FIGS. 15 and 16, in single valve bridge brake embodiments according to aspects of the present disclosure which utilize aspects of the above described patent publication, the piston 1520 disposed in the central bore in the valve bridge 1510 serves as a master piston in a master/slave piston arrangement. The bore that houses the master piston 1520 is connected via a hydraulic passage 1512 in the valve bridge to a slave piston bore 1514 formed in alignment with an EEVO exhaust valve 1550 (i.e., the exhaust valve not associated with the brake rocker arm and bridge pin). A slave piston 1530 is disposed in the slave piston bore 1514 and operatively connected to the EEVO exhaust valve 1550.

As in the embodiment described in FIGS. 1-6, the master piston 1520 in the embodiment of FIGS. 15-16 is configured with sufficient lash space 1529 to lose EEVO motions when the master piston/slave piston circuit is not charged with hydraulic fluid. However, when this circuit is charged with hydraulic fluid, extension of the master piston 1520 out of the central bore takes up the lash space 229, thereby enabling the master piston 1520 to pick up the EEVO motions in the main event rocker 1500. In this case, however, the master piston/slave piston circuit is used to convey the EEVO motions to only the slave piston and, therefore, only to the non-braking exhaust valve. As shown in FIGS. 15-16, a reaction post assembly 1560, secured to the engine block or cylinder head, may be provided to maintain the valve bridge 1510 in horizontal alignment (i.e., to prevent rotation of the valve bridge 1510). Additionally, in this embodiment, reset is achieved not through the use of a reset pin as in the embodiment of FIGS. 1-6, but by the use of reset hole 1518 in communication with the slave piston bore 1514. During the EEVO event, the reset hole 1518 remains closed/covered by the reaction post 1562 and by virtue of interaction between the valve bridge 1510 and the reaction post 1562, thereby maintaining the hydraulic lock between the master piston 1520 and slave piston 1530. When the master piston 1520 bottoms out within the central bore during the main event, the valve bridge 1510 is moved out of contact with the reaction post 1562, thereby uncovering the reset hole 1518 and permitting rapid evacuation of the master piston/slave piston hydraulic circuit. In turn, this causes the slave piston to retract into its bore 1514, thereby preventing overextension and late closing of the EEVO exhaust valve 1550.

According to another aspect of the disclosure, EEVO operation may be used in combination with cylinder deactivation to provide higher exhaust temperatures on the cylinders that are not deactivated. As known in the art, an engine may be split into some cylinders operating in a deactivated state (no fuel provided to the cylinder and no valve actuations) and some cylinders operating in positive power state. This deactivation strategy improves fuel consumption and raises exhaust temperature. However, in some operating conditions, this strategy may not provide enough heat output. In these situations, EEVO operation can further supplement heat production by cylinders providing positive power generation. In such cases, for example, a subset of the engine cylinders may be provided with an exhaust main event rocker arm that does not provide EEVO valve actuations, a collapsing valve bridge and the dedicated rocker brake (as described above). A similar collapsing valve bridge may be provided on the engine intake valves. For these cylinders, activation (or unlocking) of the collapsing valve bridge prevents all valve actuation motions from being applied to the valves, i.e., the piston in the valve bridge central bore is not allowed to bottom out at even the highest valve lift levels and the cylinder is deactivated. However, the other engine cylinders may be provided with EEVO systems such as those described above, such that EEVO operation may be applied to these cylinders. Aspects of the disclosure permit the presence of a dedicated rocker brake on all engine cylinders and thus still permits engine braking to be applied through these cylinders. Additionally, although one scheme for implementing cylinder deactivation is described herein, it will be appreciated that virtually any technique for providing cylinder deactivation may be employed. By adding the EEVO operation to the positive power cylinders while the other cylinders are deactivated, exhaust temperatures may be increased even further. Furthermore, such EEVO operation can be used to improve turbocharger response on the active cylinders when less than the full number of cylinders may not flow enough air for a turbocharger that is matched for all firing cylinders. Further still, EEVO operation on the reduced number of cylinders may help transient response, and allow operation at low mass flows and higher boost levels on engines that would otherwise be low on airflow when running partially deactivated.

Although the present implementations have been described with reference to specific example embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. A system for controlling motion of at least one exhaust valve in an internal combustion engine having at least one cylinder, the at least one exhaust valve being associated, respectively, with the at least one cylinder, the system comprising:

a main event motion source associated with each of the at least one cylinder for providing main event motion to the respective at least one exhaust valve;

an early exhaust valve opening (EEVO) motion source associated with each of the at least one cylinder for providing EEVO motion to the associated at least one exhaust valve; a main event valve train associated with each of the at least one cylinder for conveying main event motion and EEVO motion to the associated at least one exhaust valve;

an EEVO lost motion component in at least one of the main event valve trains and adapted to absorb EEVO motion from the EEVO motion source in a first operational mode and adapted to convey EEVO motion from the EEVO motion source in a second operational mode;

a braking motion source, separate from the main event motion source, associated with each of the at least one cylinder for providing braking event motion to the associated at least one exhaust valve; and a braking event valve train, separate from the main event valve train, associated with each of the at least one cylinder for conveying braking motion from the braking motion source to the associated at least one exhaust valve, wherein the EEVO lost motion component defines a lash space which limits the extent of motion that may be absorbed by the EEVO lost motion component, the lash space being substantially equal to motion in the main event valve train defined by the EEVO motion source.

2. The system of claim 1, wherein the EEVO lost motion component comprises a valve bridge and a piston slidably disposed in the valve bridge.

3. The system of claim 1, wherein the main event motion source and the EEVO motion source are defined on a single cam.

4. The system of claim 1, wherein the EEVO lost motion component includes a reset component for resetting the EEVO lost motion component from the second operational mode to the first operational mode during main event motion of the at least one valve.

5. The system of claim 1, wherein at least two of the EEVO motion sources define different EEVO event profiles.

6. The system of claim 1, further comprising a controller for controlling operation of the EEVO lost motion components, the controller including a processor and memory for storing instructions to be executed by the processor, the instructions providing logic for activating at least one of the EEVO lost motion components based on at least one sensed engine parameter.

7. The system of claim 6, further comprising at least two EEVO control valves, each one of the at least two EEVO control valves associated with at least a respective one of the EEVO lost motion components, wherein the instructions provide logic for:

activating a first one of the at least two EEVO control valves to achieve a first level of engine aftertreatment heating; and activating a second one of the at least two EEVO control valves to achieve a second level of engine aftertreatment heating.

8. The system of claim 6, further comprising at least one EEVO control valve associated with a respective one of the EEVO lost motion components, wherein the instructions provide logic for:

duty cycling the at least one EEVO control valve to achieve a desired level of engine aftertreatment heating.

9. The system of claim 6, wherein at least two of the EEVO motion sources have different EEVO event profiles defined thereon, the system further comprising a respective EEVO control valve for controlling each of EEVO lost motion components, wherein the instructions provide logic for operating at least one of the EEVO control valves to deactivate a respective EEVO lost motion component when engine load increases above a predetermined threshold.

10. The system of claim 6, further comprising at least two EEVO control valves, a first one of the at least two EEVO control valves is adapted to control EEVO lost motion components for a first number of cylinders and a second one of the at least a two EEVO control valves is adapted to control EEVO lost motion components for a second number of cylinders, wherein the first number is different from the second number.

11. The system of claim 6, wherein the at least one sensed engine parameter is selected from the group consisting of engine speed, engine load, engine exhaust temperature, exhaust gas recirculation temperature, turbo boost level, and aftertreatment temperature.

12. The system of claim 6, wherein the instructions provide logic for increasing fuel to at least one of the cylinders based on the at least one sensed engine parameter.

13. A system for controlling motion of at least one exhaust valve in an internal combustion engine having at least one cylinder, the at least one exhaust valve being associated, respectively, with the at least one cylinder, the system comprising:

a main event motion source associated with each of the at least one cylinder for providing main event motion to the respective at least one exhaust valve;

an early exhaust valve opening (EEVO) motion source associated with each of the at least one cylinder for providing EEVO motion to the associated at least one exhaust valve, wherein the main event motion source and EEVO motion source are defined on a single cam;

a main event valve train associated with each of the at least one cylinder for conveying main event motion and EEVO motion to the associated at least one exhaust valve;

an EEVO lost motion component in at least one of the main event valve trains and adapted to absorb EEVO motion from the EEVO motion source in a first operational mode and adapted to convey EEVO motion from the EEVO motion source in a second operational mode;

a braking motion source, separate from the main event motion source, associated with each of the at least one cylinder for providing braking event motion to the associated at least one exhaust valve; and a braking event valve train, separate from the main event valve train, associated with each of the at least one cylinder for conveying braking motion from the braking motion source to the associated at least one exhaust valve.

14. A system for controlling motion of at least one exhaust valve in an internal combustion engine having at least one cylinder, the at least one exhaust valve being associated, respectively, with the at least one cylinder, the system comprising:

a main event motion source associated with each of the at least one cylinder for providing main event motion to the respective at least one exhaust valve;

an early exhaust valve opening (EEVO) motion source associated with each of the at least one cylinder for providing EEVO motion to the associated at least one exhaust valve;

a main event valve train associated with each of the at least one cylinder for conveying main event motion and EEVO motion to the associated at least one exhaust valve;

at least one EEVO lost motion component in at least one of the main event valve trains and adapted to absorb EEVO motion from the EEVO motion source in a first operational mode and adapted to convey EEVO motion from the EEVO motion source in a second operational mode;

a braking motion source, separate from the main event motion source, associated with each of the at least one cylinder for providing braking event motion to the associated at least one exhaust valve;

a braking event valve train, separate from the main event valve train, associated with each of the at least one cylinder for conveying braking motion from the braking motion source to the associated at least one exhaust valve;

a controller for controlling operation of the EEVO lost motion components, the controller including a processor and memory for storing instructions to be executed by the processor, the instructions providing logic for activating at least one of the EEVO lost motion components based on at least one sensed engine parameter;

at least two EEVO control valves, each one of the at least two EEVO control valves associated with at least a respective one of the at least one EEVO lost motion component, wherein the instructions provide logic for:

activating a first one of the at least two EEVO control valves to achieve a first level of engine aftertreatment heating; and activating a second one of the at least two EEVO control valves to achieve a second level of engine aftertreatment heating.

15. A system for controlling motion of at least one exhaust valve in an internal combustion engine having at least one cylinder, the at least one exhaust valve being associated, respectively, with the at least one cylinder, the system comprising:

a main event motion source associated with each of the at least one cylinder for providing main event motion to the respective at least one exhaust valve;

an early exhaust valve opening (EEVO) motion source associated with each of the at least one cylinder for providing EEVO motion to the associated at least one exhaust valve;

a main event valve train associated with each of the at least one cylinder for conveying main event motion and EEVO motion to the associated at least one exhaust valve;

at least one EEVO lost motion component in at least one of the main event valve trains and adapted to absorb EEVO motion from the EEVO motion source in a first operational mode and adapted to convey EEVO motion from the EEVO motion source in a second operational mode;

a braking motion source, separate from the main event motion source, associated with each of the at least one cylinder for providing braking event motion to the associated at least one exhaust valve;

a braking event valve train, separate from the main event valve train, associated with each of the at least one cylinder for conveying braking motion from the braking motion source to the associated at least one exhaust valve;

a controller for controlling operation of the EEVO lost motion components, the controller including a processor and memory for storing instructions to be executed by the processor, the instructions providing logic for activating at least one of the EEVO lost motion components based on at least one sensed engine parameter;

wherein the at least one cylinder is at least two cylinders and wherein at least two of the EEVO motion sources have different EEVO event profiles defined thereon, the system further comprising a respective EEVO control valve for controlling each of EEVO lost motion components, wherein the instructions provide logic for operating at least one of the EEVO control valves to deactivate a respective EEVO lost motion component when engine load increases above a predetermined threshold.

16. A system for controlling motion of at least one exhaust valve in an internal combustion engine having at least one cylinder, the at least one exhaust valve being associated, respectively, with the at least one cylinder, the system comprising:

a main event motion source associated with each of the at least one cylinder for providing main event motion to the respective at least one exhaust valve;

an early exhaust valve opening (EEVO) motion source associated with each of the at least one cylinder for providing EEVO motion to the associated at least one exhaust valve;

a main event valve train associated with each of the at least one cylinder for conveying main event motion and EEVO motion to the associated at least one exhaust valve;

at least one EEVO lost motion component in at least one of the main event valve trains and adapted to absorb EEVO motion from the EEVO motion source in a first operational mode and adapted to convey EEVO motion from the EEVO motion source in a second operational mode;

a braking motion source, separate from the main event motion source, associated with each of the at least one cylinder for providing braking event motion to the associated at least one exhaust valve;

a braking event valve train, separate from the main event valve train, associated with each of the at least one cylinder for conveying braking motion from the braking motion source to the associated at least one exhaust valve;

a controller for controlling operation of the EEVO lost motion components, the controller including a processor and memory for storing instructions to be executed by the processor, the instructions providing logic for activating at least one of the EEVO lost motion components based on at least one sensed engine parameter; and at least two EEVO control valves, a first one of the at least two EEVO control valves being adapted to control EEVO lost motion components for a first number of cylinders and a second one of the at least a two EEVO control valves is adapted to control EEVO lost motion components for a second number of cylinders, wherein the first number is different from the second number.

* * * * *